United States Patent [19]

Salemi

[11] 4,038,628

[45] July 26, 1977

[54] ELECTRIC RESISTOR

[75] Inventor: Nicholas A. Salemi, Plum Borough, Pa.

[73] Assignee: Westinghouse Electric Corporation, Pittsburgh, Pa.

[21] Appl. No.: 698,226

[22] Filed: June 21, 1976

[51] Int. Cl.[2] ..... H01C 10/14

[52] U.S. Cl. ..... 338/318; 219/552; 338/278; 338/296; 338/305; 338/316

[58] Field of Search ..... 338/278, 296, 301, 304, 338/305, 315, 316, 318; 219/552, 553

[56] References Cited

U.S. PATENT DOCUMENTS

| | | | |
|---|---|---|---|
| 1,951,846 | 3/1934 | Scharf | 338/301 X |
| 2,275,840 | 3/1942 | Britton et al. | 338/278 |
| 2,390,790 | 12/1945 | Immel et al. | 338/278 X |
| 2,560,690 | 7/1951 | Griffes et al. | 338/278 X |

*Primary Examiner*—C. L. Albritton
*Attorney, Agent, or Firm*—L. P. Johns

[57] ABSTRACT

An electric resistor assembly for use in motor starters or other electric apparatus characterized by an elongated mounting strap having terminals at both ends respectively for panel mounting, a plurality of insulating refractory bodies on the strap in end-to-end abutment, one end wall of each body having a bulged portion protruding from the end wall, the other end wall having a cavity corresponding to and receptive of the bulged portion of an adjacent body, and a helical resistance conductor mounted on and surrounding the bodies.

9 Claims, 8 Drawing Figures

ELECTRIC RESISTOR

BACKGROUND OF THE INVENTION

1. Field of the Invention:

This invention relates to electrical resistors and more particularly to resistor units for use in motor starters or other electric apparatus which are exposed to heavy shock forces.

2. Description of the Prior Art:

Electric resistor units of the type disclosed in U.S. Pat. Nos. 1,550,641, 2,249,474, and Re. No. 22,313 disclosed resistance conductors of the ribbon type wound helically on refractory insulators which in turn are supported on elongated metal straps. When these assemblies are subjected to high impact shock, or low frequency vibration due to jogging during road shipment, or in low frequency vibration in use due to adjacent machinery, the straps tend to sag and thereby crack the ceramic insulators.

Various attempts to overcome that problem have been made, such as the resistance unit shown in U.S. Pat. No. 2,390,790, in which a plurality of insulators are mounted on a support strap in end-to-end abutment with rounded end surfaces to impart a rolling action of abutting end surfaces of adjacent insulators when the support straps bend. However, the straps bend or flex horizontally in response to heavy shock forces such as occur on naval vessels when the guns are fired.

Associated with the foregoing has been a problem of providing a suitable fastening means for mounting the refractory insulators on the support strap in a fool-proof manner. A recurring difficulty of fastening means of prior construction has been the failure of metal fastening means due to overheating in normal use.

SUMMARY OF THE INVENTION

In accordance with this invention it has been found that the foregoing problems may be overcome by providing an electric resistor assembly comprising an elongated mounting strap having terminals at both ends respectively for panel mounting, the mounting strap having a flexing direction, a plurality of insulating refractory bodies disposed on the strap in end-to-end abutment, the axis of angular motion of the bodies being horizontal, the bodies having opposite vertical side walls, opposite end walls, and upper and lower edges, one end wall of each body having a bulged portion protruding from the end wall, the other end wall having a concavity corresponding to and receptive of the bulge portion of an adjacent body to enable angular motion of the adjacent bodies in the flexing direction, the bulged portion and the concavity having coaxial surfaces in a horizontal plane perpendicular to the axis of the mounting strap, the bulged portion and the concavity being located in the upper half portions of each body, the end wall of each body comprising an arcuate surface between the bulged portion and the lower edge, the other end wall comprising a second arcuate surface between the concavity and the lower edge, a helical resistance conductor mounted on and surrounding the bodies, and the upper and lower edges comprising spaced notches in which the helical resistor conductor is mounted.

This invention also comprises an electrical resistor assembly comprising an elongated mounting strap having terminals at both ends respectively for panel mounting, a plurality of insulating refractory bodies disposed on the strap in end-to-end abutment, the bodies having U-shaped cross-sections including a pair of spaced legs and an intermediate side, each leg comprising a projection from both ends of the body, the projections being laterally spaced from the intermediate side by a distance equal to about one-half the thickness of the strap, and adjacent bodies being mounted on the strap with the intermediate sides adjacent opposite sides of the straps and with the projections of the adjacent bodies in overlapping positions.

The advantage of the electric resistor assembly of this invention is that it provides refractory bodies having configurations adapted to avoid damage to the bodies when the mounting strap is vertically deflected, and it provides for refractory bodies comprising self-mounting means.

DESCRIPTION OF THE PREFERRED EMBODIMENTS

Figure 3:
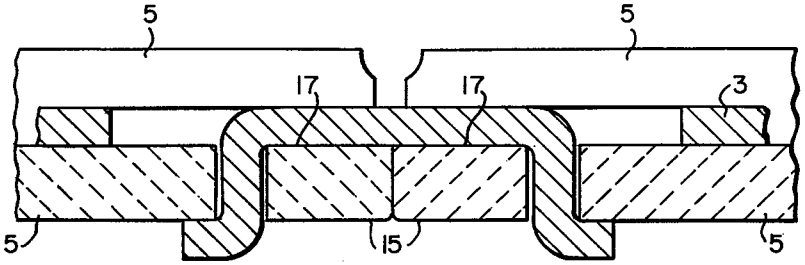
FIG. 3 is a fragmentary horizontal sectional view taken on the line III—III of FIG. 1.
Figure 1:
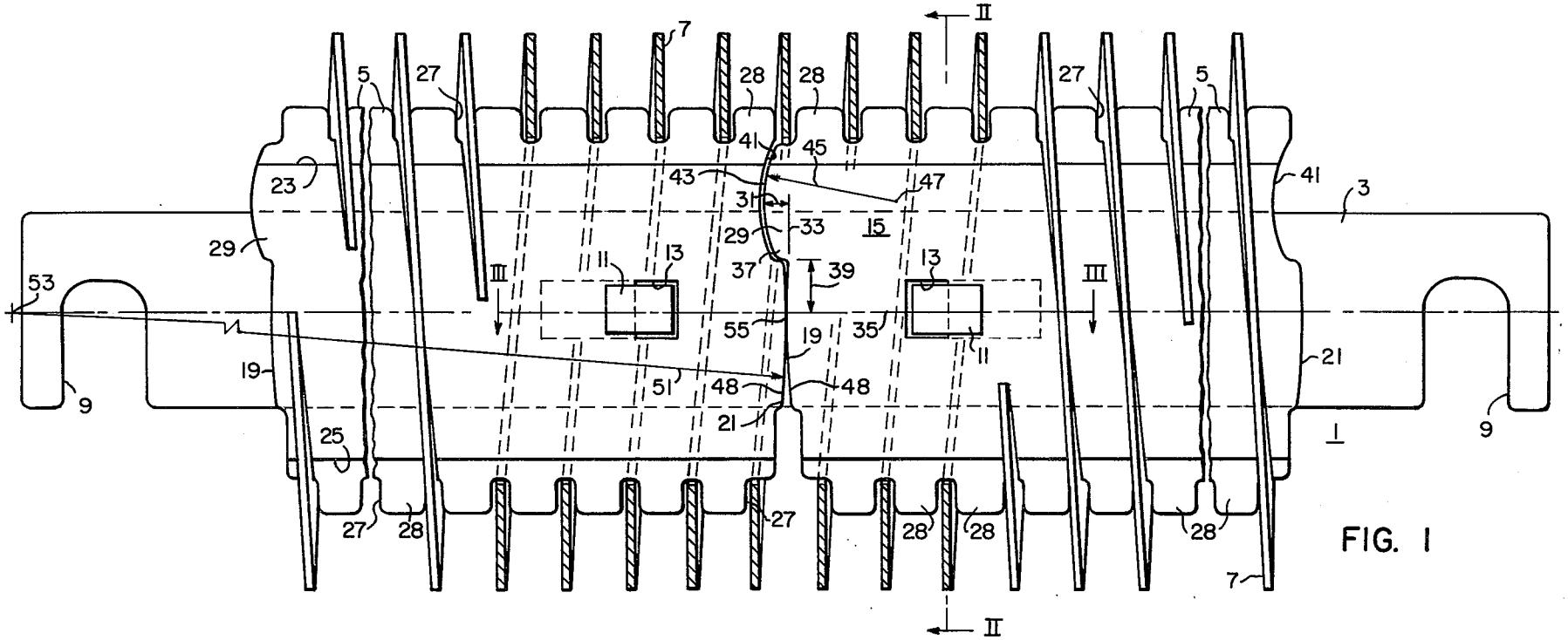
FIG. 1 is an elevational view of an electric resistor assembly in accordance with this invention.

In FIG. 1 an electric resistor assembly is generally indicated at 1 and it comprises a mounting strap or strut 3, a plurality of insulating bodies for refractory insulators 5, and a helical resistance conductor 7. The assembly is adapted for hanging on a panel in a conventional manner for which reason the mounting strap 3 comprises similar hooks or slots 9 for panel mounting on suitable terminals. The strap 3 is an elongated strap having a rectangular cross-section (FIG. 2) and is preferably comprised of a suitable heat refractory metal. At suitable spaced intervals the strap 3 comprises fastening tabs 11 (FIG. 3) which are lanced out of the strap and turned over after the insulators 5 are assembled to the strap by extending through apertures 13 in the insulators.

Figure 2:
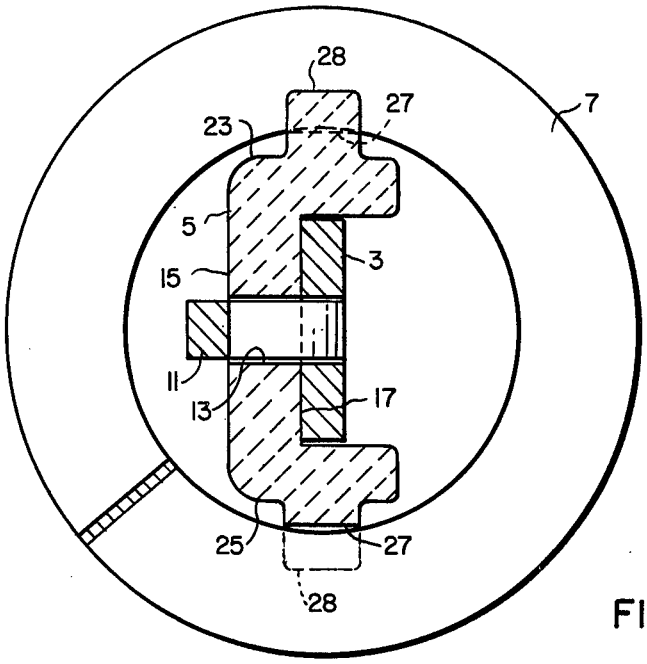
FIG. 2 is a vertical sectional view taken on the line II—II of FIG. 1.

The insulators 5 are generally molded ceramic members and comprise vertical side walls 15 and 17, end walls 19, 21, and upper and lower edges 23, 25. As shown in FIG. 2 the insulator has a C-shaped cross-section which readily adapts the insulator for mounting on the strap 13 so that the side wall 17 fits snugly against the strap. The upper and lower edges 23, 25 include suitably spaced notches 27 which are separated by projections 28.

In accordance with this invention the end walls 19, 21 are provided with means for slightly rolling against the end walls of adjacent insulators. Such rolling occurs when the strap 3 sags or vibrates up and down between the hooks 9. The electric resistor assemblies 1 are subjected to vertical vibration during shipment. Low frequency vibrations of about 60 cycles occur in the strap 3 due to movement of a shipping vehicle such as a truck.

In addition, similar low frequencies or vibration modes may occur at the location of use due to floor vibrations caused by adjacent machinery in a building. These vibrations in the strap 3 have been sufficient to cause damage to the insulators 5 due to end movement or rolling between adjacent insulators. For that reason the left-end 19 of each insulator 5 as viewed in FIG. 1 includes a bulged portion 29 which projects by a distance indicated by the arrows 31 from a line 33 perpendicular to the axis 35 of the strap 3 which axis is also the axis of the assembly 1. The lower end 37 of the bulge 29 may coincide with the axis 35, but is preferably located a distance indicated by arrows 39 above the axis 35. The right-end of each insulator 5 includes a corresponding cavity 41 having a rounded configuration similar to the rounded surface 43 of the projection 29. Moreover, the rounded surface 43 and the cavity are preferably cylindrical extending across the upper portion of the insulators 5 and being substantially coaxial on the radius 45 extending from an axial center 47. The axis 47 and the curved surface 43 extend in directions perpendicular to the axis 35. Accordingly, when the strap 3 deflects or sags or virbates vertically, the axis of annular motion of the insulators 5 is substantially horizontal and the arcuate surface 43 and the cavity 41 roll slightly in conjunction with the deflection of the strap.

In addition, in accordance with this invention as the stap returns from its lower position in the vibration cycle, it moves upward slightly for which reason the lower portion of the adjacent insulators 5 (below the axis 35) are provided with abutting arcuate surfaces 47, depending from a radius 51 having a center 53 disposed in the axis 35. The radius 51 is substantially eight times that of the radius 45 of the surface 43. During periods of normal operation when the assembly is static, i.e., not vibrating, the adjacent insulators 5 are in contact at a point 55 on the axis 35. As a result of the above described construction the insulators 5 are free to roll in end-to-end abutment with each other without deleterious effects such as cracking due to any binding between them.

The conductor 7 (FIG. 2) is a helix wound around the assembly of the strap 3 and insulators 5 with each convolution of the helix disposed in the spaced notches 27 where they are retained between the projections 28 between each notch. The resistance conductor 7 is preferably a ribbon wound on its edge in the notches 27 and comprises a heat refractory resistance material, such as an alloy containing nickel and chromium, which is suitably formed into the helical edgewise shape as shown.

Figure 4:
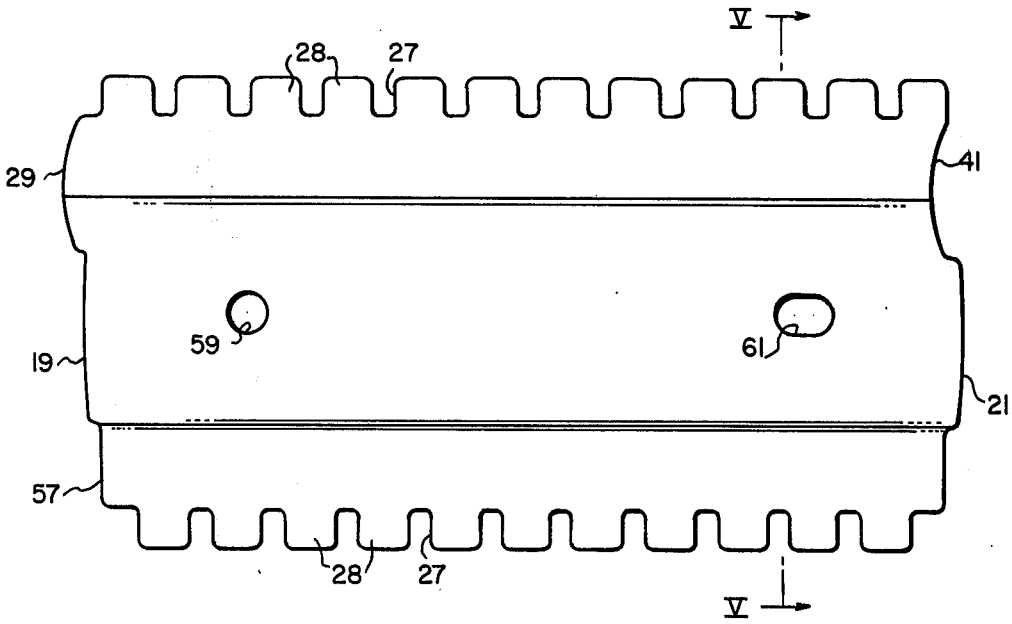
FIG. 4 is an elevational view showing an alternate embodiment of the invention.
Figure 5:
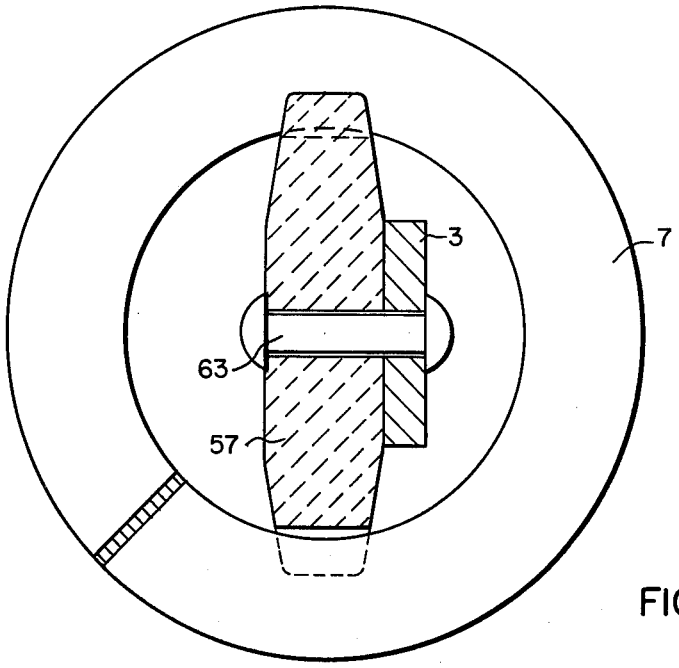
FIG. 5 is a vertical sectional view of another embodiment of the refractory insulator.

In FIGS. 4 and 5 another embodiment of the insulator is shown in which an insulator 57 is substantially similar to the insulator 5 and is therefore provided with corresponding reference numbers for similar parts. The insulator 57 differs from the insulator 5 in that it comprises a pair of spaced mounting means including a hole 59 and a slot 61. The hole 59 and the slot 61 differ from the aperture 13 because different mounting means are provided namely a rivet or bolt extend through each opening 59, 61 for mounting on the strap 3 (FIG. 5). The slot 61 accommodates expansion and contraction of the insulator.

In addition as shown in FIG. 5 the insulator 57 has a substantially rectangular cross-section area as compared with the C-shaped cross-section of the insulator 5. A helical resistance conductor 7 is similar mounted on the insulator 5 as shown.

Figure 7:
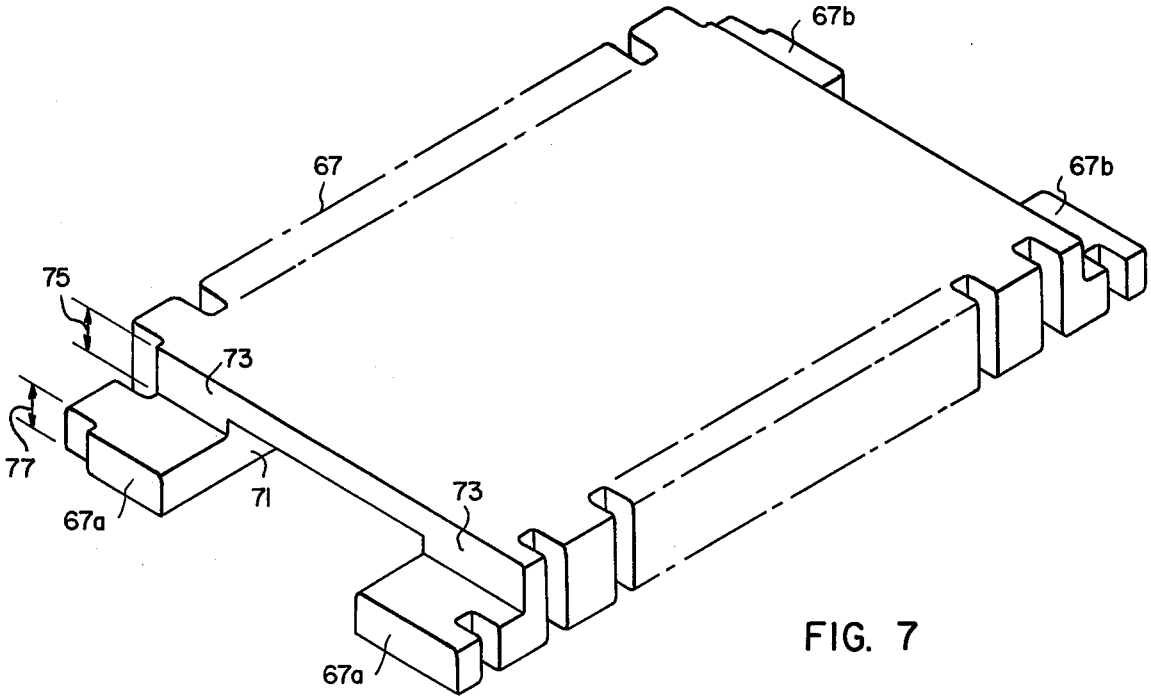
FIG. 7 is an isometric view of the refractory insulator as shown in FIG. 6.
Figures 6, 8:
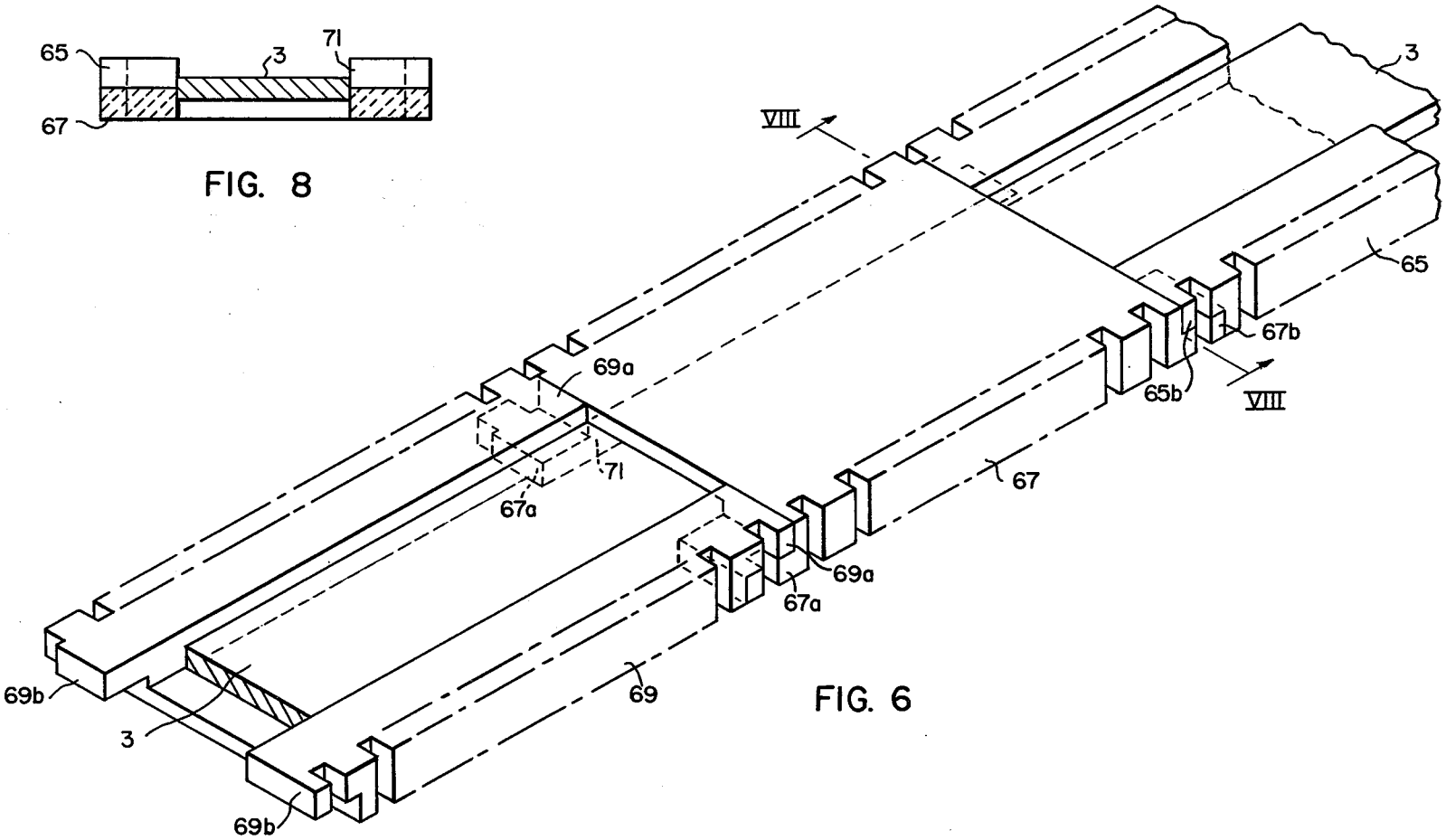
FIG. 6 is an isometric view of another embodiment of the electric resistor assembly of this invention.
FIG. 8 is a sectional view taken on the line VIII—VIII of FIG. 6.

Still another embodiment of the invention is shown in FIGS. 6 and 7 in which a segmented insulator comprising insulators 65, 67, 69 are mounted on a strap 3 without the use of separate fastening means. Each insulator 65, 67, 69 is dependent upon the adjacent insulator to hold the insulators in place on the strap 3. The insulator 65, 67, 69 are similar in construction and positioned alternately on opposite sides of the strap 3. The insulator 67, for example, has a C-shaped cross-section with an inner longitudinal channel 71 in which the strap 3 is disposed against the intermediate portion of the insulator. The insulator 67 includes a pair of projections **67*a* at one end and another pair of projections 67*b* at the other end. The projections extend beyond corresponding ends of the insulator and have thicknesses less than the thickness of the insulator so as to provide aligned notches 73. The notches 73 have a dimensioned indicated by an arrow 75 equal to the dimension of the arrow 77 of the projection 67*a*. Similar conditions obtained at the opposite end of the insulator for the projection 67*b*. Accordingly, adjacent insulator 65, 67, 69 may be assembled with overlapping projections 67*a* and 65*a* at one end and 67*b* and 69*a* at the other end. The insulators cooperate to maintain themselves on the strap 3. Here, then, is a configuration of an electrical resistor insulator which offers an interlock feature which eliminates fasteners except for the end pieces which are restrained by suitable fastening means at only one end. The alternate stacking of the insulators 65, 67, 69 on opposite sides of the strap 3** provides a self-hold on feature.

The edge wound resistors of this invention are designed for good mechanical and electrical properties after repeated heating up to about 600° C and require an insulator that withstands mechanical shock and provides means for holding a coiled resistor in place. The insulators 5, 57, 67 are generally molded ceramic and may be fabricated in segmented pieces to make up a specific length. As a result, problems existing in the insulators of prior construction have been eliminated.

What is claimed is:

1. An electric resistor assembly comprising an elongated mounting strap having terminals at both ends respectively for panel mounting, the mounting strap having a flexing direction, a plurality of insulating refractory bodies disposed on the strap in end-to-end abutment, the bodies having opposite vertical side walls, opposite end walls, and upper and lower edges, one end wall of each body having a bulged portion protruding from the end wall, the other end wall having a concavity corresponding to and receptive of the bulged portion of adjacent body, to enable angular motion of the adjacent bodies in the flexing direction, and a helical resistance conductor mounted on and surrounding the bodies.

2. The electric resistor assembly of claim 1 in which the axis of angular motion of the bodies is horizontal.

3. The electric resistor assembly of claim 2 in which the bulged portion and the concavity have coaxial surfaces.

4. The electrical resistor assembly of claim 3 in which the axis of the bulged portion is horizontal and substantially perpendicular to axis of the mounting strap.

5. The electric resistor assembly of claim 4 in which the bulged portion and concavity are located in the upper half portion of each body.

6. The electric resistor assembly of claim 5 in which the one end wall of each body comprises an arcuate surface between the bulged portion and the lower edge, and the other end wall comprises a second arcuate surface between the concavity and the lower edge.

7. The electric resistor assembly of claim 1 in which the upper and lower edges comprise spaced notches in which the helical resistor conductor is mounted.

8. An electric resistor assembly comprising an elongated mounting strap having terminals at both ends respectively for panel mounting, a plurality of insulating refractory bodies is disposed on the strap in end-to-end abutment, the bodies having U-shaped cross-sections including a pair of spaced legs and an intermediate side, each leg comprising a projection from both ends of the body, and adjacent bodies being mounted on the strap with the intermediate sides adjacent opposite sides of the strap and with the projections of adjacent bodies in overlapping positions.

9. The electric resistor assembly of claim 8 in which the projections are laterally spaced from the intermediate side by a distance equal to about one-half the thickness of the strap.

* * * * *